US009007006B2

(12) United States Patent
Yun

(10) Patent No.: US 9,007,006 B2
(45) Date of Patent: Apr. 14, 2015

(54) PUMP SYSTEM AND METHOD FOR OPERATING THE SAME

(75) Inventor: Hong Min Yun, Anyang-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 39 days.

(21) Appl. No.: 13/420,517

(22) Filed: Mar. 14, 2012

(65) Prior Publication Data

US 2012/0235619 A1 Sep. 20, 2012

(30) Foreign Application Priority Data

Mar. 18, 2011 (KR) ..... 10-2011-0024558

(51) Int. Cl.
*H02P 1/04* (2006.01)
*B08B 5/04* (2006.01)
*F04B 49/06* (2006.01)

(52) U.S. Cl.
CPC ..... *F04B 49/06* (2013.01); *F04B 2203/0202* (2013.01); *F04B 2203/0204* (2013.01)

(58) Field of Classification Search
CPC ..... F01L 1/022; F01L 2103/01; F02D 13/04; F02D 17/02; F02D 2041/0012; F02D 2200/0406; F02D 2200/0802; F02D 2250/41; F02D 41/0087; F02D 41/123; F02N 11/006; F02N 11/0818; F02N 11/10; H02P 7/06
See application file for complete search history.

(56) References Cited

U.S. PATENT DOCUMENTS

| | | | | |
|---|---|---|---|---|
| 4,880,474 | A * | 11/1989 | Koharagi et al. | 134/21 |
| 5,461,296 | A * | 10/1995 | Messersmith et al. | 318/779 |
| 2010/0043409 | A1 * | 2/2010 | Naydenov et al. | 60/287 |

FOREIGN PATENT DOCUMENTS

| | | |
|---|---|---|
| CN | 2011-14166 | 9/2008 |
| CN | 101584110 | 11/2009 |
| JP | 09-112437 | 5/1997 |
| JP | 2003-278659 A | 10/2003 |
| JP | 2007-187067 A | 7/2007 |

OTHER PUBLICATIONS

The State Intellectual Property Office of the People's Republic of China Application Serial No. 201210065896.2, Office Action dated Mar. 17, 2014, 8 pages.

Japan Patent Office Application Serial No. 2012-058704, Office Action dated Jul. 17, 2013, 3 pages.

* cited by examiner

*Primary Examiner* — Paul Ip
*Assistant Examiner* — Devon Joseph
(74) *Attorney, Agent, or Firm* — Lee, Hong, Degerman, Kang & Waimey

(57) ABSTRACT

Provided is a pump system. The pump system includes an AC (alternating current) electric motor, a converter, a smoothing unit, an inverter, a volt/hertz pulse width-modulation controller, and a main controller. The AC electric motor operates a pump which is a load. The converter receives AC power and converts the AC power into DC (direct current) power. The smoothing unit smoothes a DC voltage converted by the converter. The inverter converts the DC voltage output from the smoothing unit into an AC voltage. The volt/hertz pulse width-modulation controller applies switching voltage to a semiconductor switching device of the inverter. The main controller changes an operating frequency according to a load detected when the Ac electric motor is in operation and puts the AC electric motor to a sleep mode after determining a load operation status.

4 Claims, 3 Drawing Sheets

PUMP SYSTEM AND METHOD FOR OPERATING THE SAME

CROSS-REFERENCE TO RELATED APPLICATIONS

Pursuant to 35 U.S.C. §119(a), this application claims the benefit of earlier filing date and right of priority to Korean Patent Application No. 10-2011-0024558, filed on Mar. 18, 2011, the contents of which are hereby incorporated by reference herein in its entirety.

BACKGROUND

The present disclosure relates to a pump system, and more particularly, to a pump system and a method for operating the pump system that are designed to prevent unnecessary energy consumption caused by a no-load operation of a motor by putting the motor into sleep mode when the pump is in no-load operation in a no-flow state.

In an application field where mainly flow rate and hydraulic pressure are controlled with a fan or a pump, a multiplicity of electric motors are used to control flow rate, hydraulic pressure, air flow, or wind pressure. In general, there are a few specific requirements for electric motors used in the heating, ventilating, and air conditioning (HVAC) market to meet surrounding conditions, e.g., building communication protocols. Also, technology to deal with a situation where an electric motor is laid in a wet environment may be included in an inverter functioning as a controller. From an end user's perspective, it means the single controller conducts self-adjustment in all situations to minimize energy consumption. In addition, it may lead to a reduced total cost of ownership (TOC) for the same entire system and a reduced facility cost.

In the case of an alternating current (AC) motor driving system of the related art, the power of a commercial power source is varied in voltage and frequency and is then supplied to AC motor. Therefore, an AC motor driving system is a variable speed motor driving system in which motor speed and torque can be easily controlled with high efficiency. In such AC motor driving system, a single inverter controller may be used to control a multiplicity of electric motors mainly for adjusting the flow rate and hydraulic pressure of a fan or a pump.

In general, a controller such as an inverter controls a single main motor on a proportional-integral-derivative (PID) basis by using a built-in PID controller according to process control variables received by feedback. If necessary, an auxiliary motor may be adopted, and an external signal may be controlled for common operation and feedback control variables may be maintained constantly.

During operation control based on multi-motor control (MMC), an auxiliary motor is turned on or off automatically when a preset flow rate or hydraulic pressure is so insufficient or excessive that control by only a main motor alone is impossible. In this case, the merit is that a user can save energy by using the controller. The economical operation mentioned before may be set up by using sleep and wake modes if the load amount is small.

A controller considers the followings as a sleep mode in a pump system of the related art:

1) For operation frequency to be at or below sleep frequency satisfying a sleep condition 2) For all multi-controlled auxiliary motors of an inverter to remain halted 3) For a main feedback level to be lower than a preset level 4) Lapse of time equal to or longer than a stable system delay time set by a user In the related art, normal sleep and wake-up operations can result in energy saving if all of the abovementioned conditions are satisfied. When a controller determines that a control variable required under a load is sufficient, the controller suspends output and an inverter stops a system. In this case, if a load amount increases again with time, the controller operates the inverter for operation suitable for the load by checking a load detection sensor.

FIG. 1 is a diagram illustrating the abovementioned sleep mode operation and wake operation sequence.

Referring to FIG. 1, the sleep and wake-up operations are conducted in the aforementioned manner in most loads currently applied. However, when actual frequency does not reach sleep frequency due to pump characteristics despite a small load amount, sleep mode conversion is not made even when the load amount is small.

SUMMARY

Embodiments provide a pump system and a method for operating the pump system that are designed to convert a pump motor operation mode automatically when a pump is in no-load operation due to a no-flow state.

Embodiments also provide a pump system and a method for operating the pump system that are designed to prevent unnecessary energy consumption caused by no-load operation when a pump is in no-load operation in a no-flow state.

The scope and spirit of the present disclosure are not limited to the aforesaid, and other features not described herein will be clearly understood by those skilled in the art from descriptions below.

In one embodiment, a pump system including: an AC (alternating current) electric motor for operating a load; a converter for receiving an AC power from an outer source and converting the AC power into a DC (direct current) voltage; a smoothing unit for smoothing the DC voltage converted by the converter; an inverter for converting the DC voltage output from the smoothing unit into an AC voltage; a volt/hertz pulse width-modulation controller applying a switching voltage to a semiconductor switching device of the inverter; and a main controller which changes an operating frequency according to a load amount detected when the Ac electric motor is in operation and switches an operation mode of the AC electric motor into a sleep mode after determining a load operation status.

The main controller may collect phase current data according to the DC voltage input to the inverter and three-phase voltage output from the inverter, and may output a voltage instruction V* and a frequency instruction f* to the volt/hertz pulse width-modulation controller.

The main controller may change the operating frequency if the load amount detected when the AC electric motor is in operation is equal to or below a preset reference load amount.

When the AC electric motor is in operation, the load amount may be detected using a load detection sensor comprising at least one of a flowrate sensor and a pressure sensor.

The main controller may accumulate load statuses for a certain time during the load amount detection and may change the operating frequency according to the accumulated load statuses.

The pump system may further include a memory for storing a reference load amount, a load feedback value, and a program for switching between the operation mode and the sleep mode.

In another embodiment, there is provided a method for operating a pump system, the method including: detecting a load amount when an AC electric motor operates; changing an operating frequency according to the detected load amount; checking a load feedback value according to the changed operating frequency; and switching an operation mode of the AC electric motor into a sleep mode according to a change in the load feedback value.

It may be determined whether the detected load amount is equal to or less than a preset reference load amount, and if the detected load amount is equal to or less than the preset reference load amount, the operating frequency may be changed.

Load amount statuses may be accumulated for a certain time, and the operating frequency may be changed according to the accumulated load amount statuses.

If the accumulated load amount statuses are within a reference range, the operating frequency may be changed.

The operating frequency may be changed a predetermined number of times according to the detected load amount, and if no change is detected in the load feedback value although the operating frequency is changed a predetermined number of changes, the operation mode of the AC electric motor may be maintained in the normal operation modes.

If the load feedback value is changed, it may be determined as a no-load operation caused by no flow, and the operation mode of the AC electric motor may be switched into the sleep mode.

DETAILED DESCRIPTION OF THE EMBODIMENTS

Terms used in the specification and claims are not limited to general meanings or those explained in dictionaries. That is, since inventors can define terms for properly describing their inventions, terms used herein should be interpreted in accordance with the spirit and scope of the present disclosure.

Embodiments and configurations described and shown in the specification and drawings are exemplary ones and do not represent all the spirit and scope of the present disclosure, and thus it will be understood that various equivalents and modifications may be made therefrom.

Figure 1:
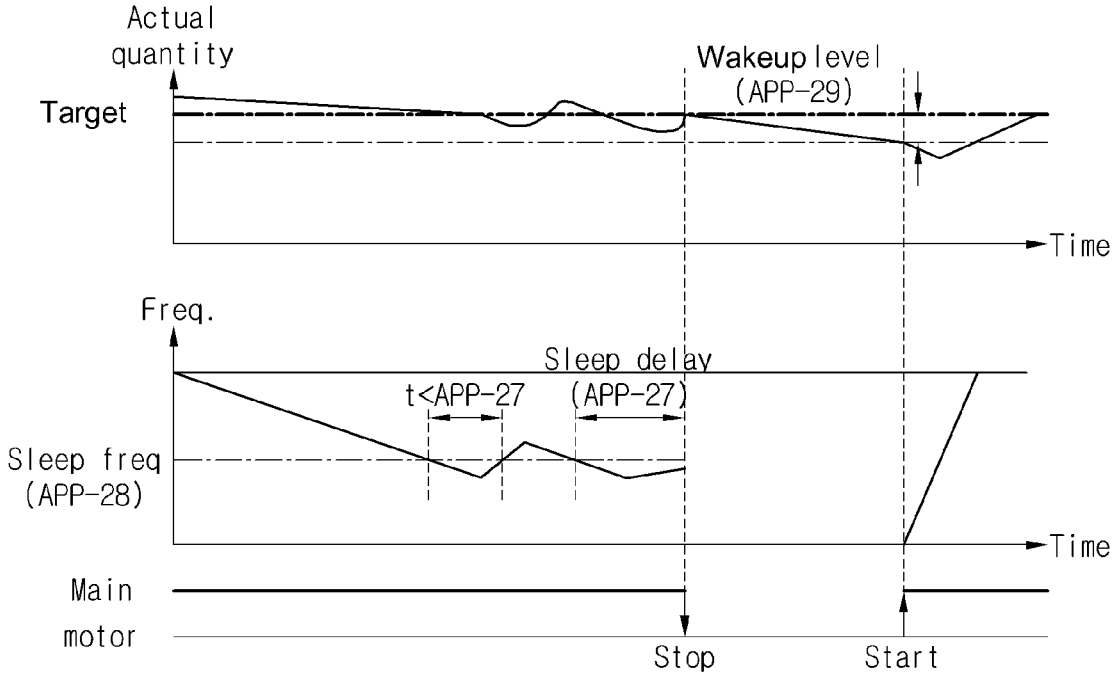
FIG. 1 is a diagram illustrating a sleep mode operation and a wake operation sequence in a pump system of the related art.
Figure 2:
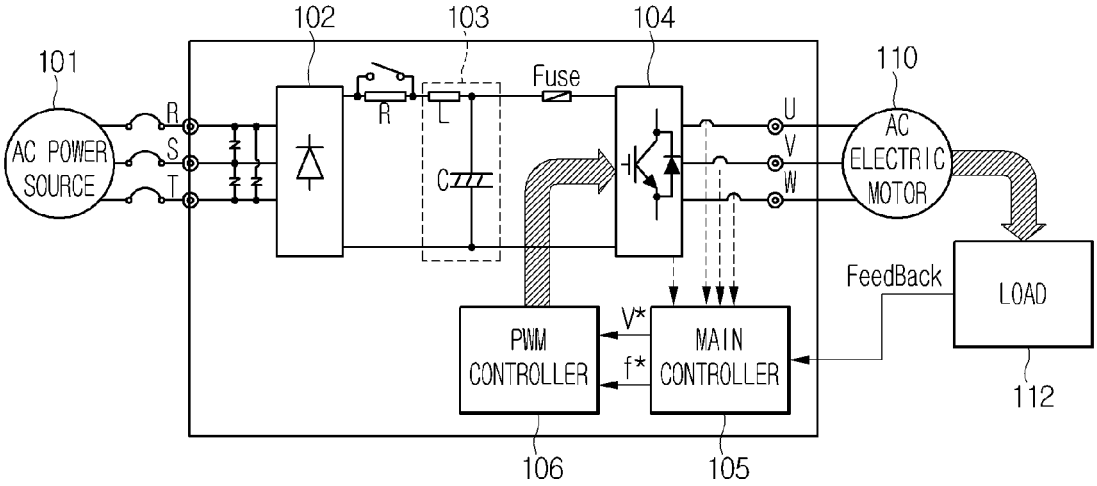
FIG. 2 is a schematic view illustrating an AC motor control system according to an embodiment.

FIG. 2 is a schematic view illustrating an AC motor control system according to an embodiment.

Referring to FIG. 2, the AC motor operation system includes a converter 102, a filter capacitor 103, a pulse width-modulation (PWM) inverter 104, a main controller 105, and a volt/hertz (v/f) PWM controller 106.

The converter 102 receives AC voltage from an AC power source 101 and converts the voltage into direct current (DC) voltage to operate an AC electric motor 110.

The filter capacitor 103 smoothes the DC voltage converted by the converter 102.

The PWM inverter 104 converts the DC voltage output from the filter capacitor 103 into AC voltage and may modulate widths of AC pulses according to a variable voltage and a variable frequency.

The main controller 105 collects data such as phase current according to three-phase voltage and DC voltage input from the PWM inverter 104, and orders various operations.

The main controller 105 may detect a load amount from a load detection sensor (not illustrated) when the AC electric motor 110 is in operation. The main controller 105 may compare the detected load amount with a preset reference load amount. The main controller 105 may modulate an operating frequency if the detected load amount is equal to or below the preset reference load amount. When a flowrate caused by a pump is zero, the main controller 105 may determine that the pump operates in a no-load operation state based on a change in load feedback. The main controller 105 may put the AC electric motor 110 to a sleep mode according to the determined operation state.

The main controller 105 saves reference load amount and load feedback data for variation of the operating frequency of the AC electric motor 110, and may further include a memory for saving a program for sleep mode conversion.

Also, the load amount may be detected by using a sensor including at least one of a flowrate sensor and a pressure sensor.

The V/f PWM controller 106 creates a PWM waveform according to a voltage instruction value V* and a frequency instruction value f* output from the main controller 105, and may apply switching voltage to a switching device of each phase of the PWM inverter 104.

The AC electric motor 110 may be operated by the PWM inverter 104.

The AC Electric Motor 110

A load 112 may be operated by the AC electric motor 110. The load may be a pump.

Figure 3:
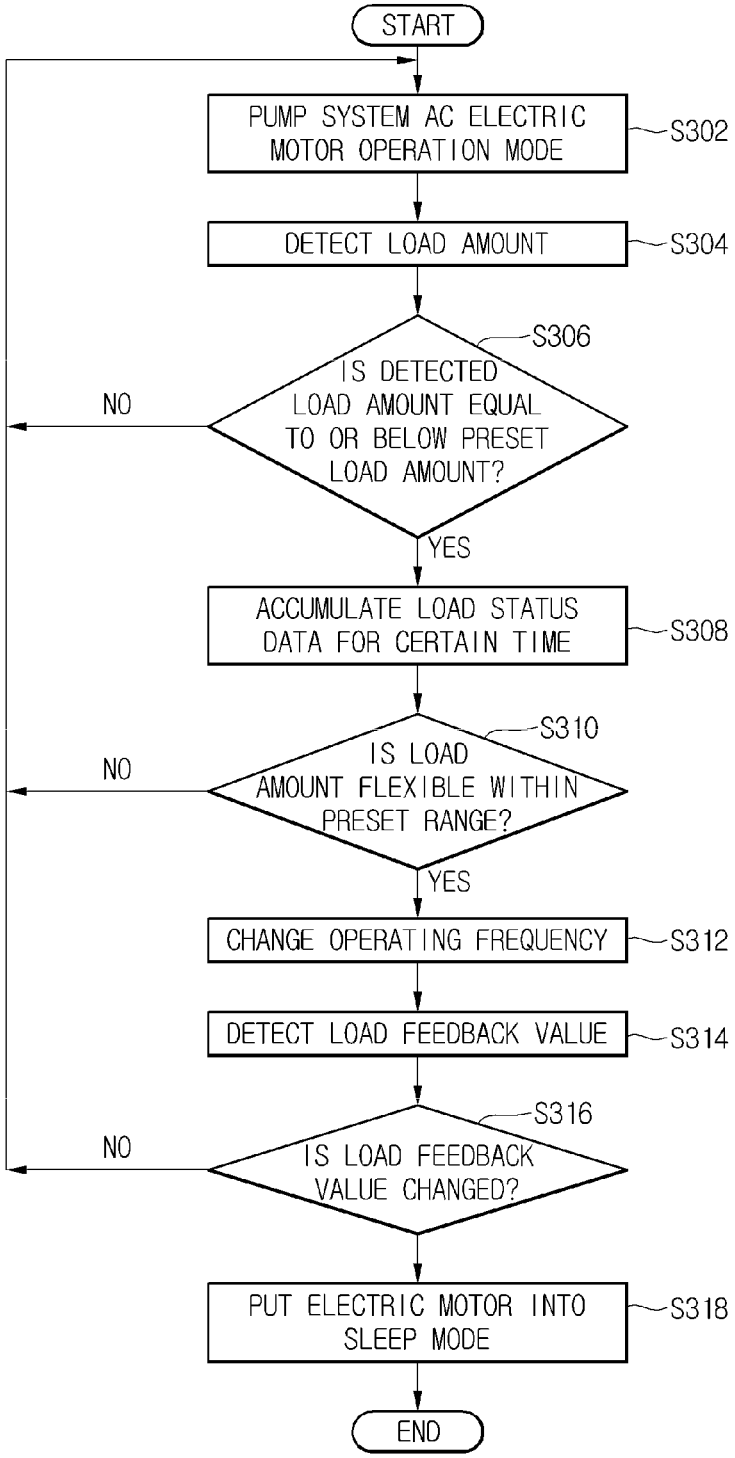
FIG. 3 is a flowchart for explaining a method for operating a pump system according to an embodiment.

FIG. 3 is a flowchart for explaining a method for operating a pump system according to an embodiment.

Referring to FIG. 3, the AC electric motor 110 of the pump system operates in operation mode (S302).

The main controller 105 detects a load amount from a load detection sensor (not illustrated) (S304).

The main controller 105 determines whether the detected load amount is equal to or below a preset reference load amount (S306).

If the detected load amount exceeds the reference load amount, the main controller 105 keeps the AC electric motor 110 in normal operation mode.

If the detected load amount is equal to or below the preset reference load amount, the main controller 105 may accumulate load amount status data for a certain time (S308). The load amount status data is accumulated for the certain time, and temporary problems such as instant load amount decrease or increase or normalization are taken into consideration.

The main controller 105 checks the load amount status data accumulated for the certain time, and may determine whether the load amount changed flexibly within a standard range (S310).

The main controller 105 may change the operating frequency to an arbitrary value if the load amount is determined to have been changed flexibly within the standard range (S312).

The main controller 105 detects a load feedback value according to the operating frequency changed to the arbitrary value (S314). The main controller 105 changes the operating frequency into the arbitrary value a predetermined number of times, and may detect the load feedback value according thereto.

The main controller 105 determines whether the detected load feedback value has changed (S316). If the detected load feedback value has not decreased or increased, the state is regarded as a normal state, and the AC electric motor 110 is maintained in the normal operation mode.

If there is a load feedback change following a load operation frequency variation (decrease or increase in speed), the main controller 105 may determine it as a no-load operation state according to no-flow of the pump. Therefore, the AC electric motor 110 may be converted from the normal operation mode to the sleep mode (S318).

As described above, according to the pump system and the method of operating the pump system of the present disclosure, the pump motor operation mode is automatically converted to the sleep mode when the pump operates in no-flow state so that unnecessary energy consumption caused by a no-load operation can be prevented.

What is claimed is:

1. A pump control device configured to control pump in a pump system, the pump control device comprising:

an AC (alternating current) electric motor configured to drive the pump;

a converter configured to receive an AC power from an outer source and convert the AC power into a DC (direct current) voltage;

a smoothing unit connected to the converter and configured to smooth the DC voltage;

an inverter connected to the smoothing device and configured to convert the smoothed DC voltage into a three-phase AC voltage; and supply the three-phase AC voltage to the AC electric motor;

a volt/hertz pulse width-modulation controller connected to the inverter and configured to control the three-phase AC voltage supplied to the AC electric motor by applying a switching voltage to a semiconductor switching device of the inverter; and a main controller operatively connected to the volt/hertz pulse width-modulation controller, wherein, while the AC electric motor is driving the pump, the main controller is configured to receive a first load feedback value from one of a flow rate sensor or a pressure sensor located downstream from an output of the pump, based upon the first load feedback value, determine an amount of a load operated by the AC electric motor while driving the pump, compare the determined amount of the load to a preset reference load amount corresponding to a potential unloaded state of the pump, when the detected amount of the load is equal to or below the preset reference load amount, conduct a control process as follows:

accumulate load statuses of the pump for a predetermined time, analyze the accumulated load statuses to compare the accumulated load statuses to a predefined range of load statuses corresponding to an existence of the unloaded state of the pump for an extended period, when the accumulated load statuses are determined to fall within the predetermined range of load statuses corresponding to the existence of the unloaded state for the extended period, send a control signal to the volt/hertz pulse width-modulation controller in order to change an operating frequency of the AC electric motor to an arbitrary frequency value a predetermined number of times, for each of the predetermined number of times, detect a second load feedback value according to the operating frequency, determine if the second load feedback values are different from the first load feedback value, if the second load feedback values are different from the first load feedback value, switch an operation mode of the AC electric motor into a sleep mode by interrupting the supply of the three-phase AC voltage to the AC electric motor, and if the second load feedback values are not different from the first load feedback value, do not switch the operation mode of the AC electric motor into the sleep mode, and when the accumulated load statuses are determined to fall outside the predetermined range of load statuses corresponding to the existence of the unloaded state for the extended period, do not send the control signal to the volt/hertz pulse width-modulation controller so that the three-phase AC voltage supplied to the AC electric motor is not changed, and when the detected amount of the load is above the preset reference load amount, do not conduct the control process so that the three-phase AC voltage supplied to the AC electric motor is not changed.

2. The pump control device according to claim 1, wherein the main controller is further configured to send the control signal to the volt/hertz pulse width-modulation controller according to the smoothed DC voltage input to the inverter and the three-phase AC voltage output from the inverter, and wherein the control signal sent to the volt/hertz pulse width-modulation controller comprises a voltage instruction V* and a frequency instruction f* r.

3. The pump control device according to claim 1, further comprising a memory arranged to store the preset reference load amount, the first load feedback value, the predefined range of load statuses, and a program for switching the AC motor between the operation mode and the sleep mode.

4. A method for controlling a pump in a pump system, the method performed by a control device and comprising:

driving the pump with an AC (alternating current) electric motor, wherein the driving comprises:

receiving an AC power from an outer source and converting the AC power into a DC (direct current) voltage;

smoothing the DC voltage;

converting the smoothed DC voltage into a three-phase AC voltage;

supplying the three-phase AC voltage to the AC electric motor; and controlling the three-phase AC voltage supplied to the AC electric motor while the AC electric motor is driving the pump, the controlling comprising:

receiving a first load feedback value from one of a flow rate sensor or a pressure sensor located downstream from an output of the pump;

based upon the first load feedback value, determining an amount of a load operated by the AC electric motor while driving the pump;

comparing the determined amount of the load to a preset reference load amount corresponding to a potential unloaded state of the pump;

when the detected amount of the load is equal to or below the preset reference load amount, conducting a control process as follows:

accumulating load statuses of the pump for a predetermined time;

analyzing the accumulated load statuses to compare the accumulated load statuses to a predefined range of load statuses corresponding to an existence of the unloaded state of the pump for an extended period;

when the accumulated load statuses are determined to fall within the predetermined range of load statuses corresponding to the existence of the unloaded state for the extended period;

changing an operating frequency of the AC electric motor to an arbitrary frequency value a predetermined number of times;

for each of the predetermined number of times, detecting a second load feedback value according to the operating frequency;

determining if the second load feedback values are different from the first load feedback value;

if the second load feedback values are different from the first load feedback value, switching an operation mode of the AC electric motor into a sleep mode by interrupting the supply of the three-phase AC voltage to the AC electric motor; and if the second load feedback values are not different from the first load feedback value, not switching the operation mode of the AC electric motor into the sleep mode; and when the accumulated load statuses are determined to fall outside the predetermined range of load statuses corresponding to the existence of the unloaded state for the extended period, not sending the control signal to the volt/hertz pulse width-modulation controller so that the three-phase AC voltage supplied to the AC electric motor is not changed; and when the detected amount of the load is above the preset reference load amount, not conducting the control process so that the three-phase AC voltage supplied to the AC electric motor is not changed.

* * * * *